US008031897B2

(12) United States Patent
Bastyr et al.

(10) Patent No.: US 8,031,897 B2
(45) Date of Patent: Oct. 4, 2011

(54) SYSTEM AND METHOD FOR REDUCED BAFFLE VIBRATION

(75) Inventors: Kevin J. Bastyr, Somerville, MA (US); Christopher B. Ickler, Sudbury, MA (US); Ray Scott Wakeland, Marlborough, MA (US)

(73) Assignee: Bose Corporation, Framingham, MA (US)

( * ) Notice: Subject to any disclaimer, the term of this patent is extended or adjusted under 35 U.S.C. 154(b) by 845 days.

(21) Appl. No.: 12/101,187

(22) Filed: Apr. 11, 2008

(65) Prior Publication Data

US 2009/0257611 A1 Oct. 15, 2009

(51) Int. Cl.
*H04R 1/20* (2006.01)

(52) U.S. Cl. ..... 381/351; 381/335; 381/345; 381/182; 381/186

(58) Field of Classification Search ..... None
See application file for complete search history.

(56) References Cited

U.S. PATENT DOCUMENTS

| | | | | |
|---|---|---|---|---|
| 5,313,525 | A * | 5/1994 | Klasco | 381/350 |
| 5,850,460 | A * | 12/1998 | Tanaka et al. | 381/186 |
| 6,353,670 | B1 * | 3/2002 | Gasner | 381/96 |
| 6,985,593 | B2 * | 1/2006 | Nichols et al. | 381/89 |
| 7,881,488 | B2 * | 2/2011 | Holmi | 381/386 |
| 2004/0035635 | A1 * | 2/2004 | Nichols et al. | 181/206 |
| 2005/0111673 | A1 | 5/2005 | Rosen et al. | |
| 2006/0291684 | A1 * | 12/2006 | Chick et al. | 381/349 |
| 2007/0258617 | A1 * | 11/2007 | Henry | 381/423 |
| 2008/0101646 | A1 * | 5/2008 | Holmi | 381/389 |
| 2009/0257611 | A1 * | 10/2009 | Bastyr et al. | 381/332 |
| 2010/0027816 | A1 * | 2/2010 | Bastyr et al. | 381/182 |

FOREIGN PATENT DOCUMENTS

| | | |
|---|---|---|
| DE | 40 19 645 | 1/1991 |
| EP | 1679936 | 7/2006 |
| JP | 06303687 | 10/1994 |

OTHER PUBLICATIONS

International Search Report and Written Opinion dated Jun. 16, 2009, Issued in International Application No. PCT/US2009/036625, filed Mar. 10, 2009.

Internationa Search Report on Patentability dated Oct. 21, 2010 for PCT/SU2009/036625, 8 pages.

* cited by examiner

*Primary Examiner* — Marlo Fletcher

(57) ABSTRACT

A system and method for reducing baffle vibration includes balancing an inertial force generated by two or more moving diaphragms and balancing an acoustic pressure acting on a housing supporting the two or more moving diaphragms such that a net force acting on the baffle is substantially zero. The acoustic force acting on the housing may be balanced independently of the inertial force balance. In another configuration, the acoustic force acting on the housing may be balanced by a non-zero net inertial force.

9 Claims, 3 Drawing Sheets

SYSTEM AND METHOD FOR REDUCED BAFFLE VIBRATION

BACKGROUND

This disclosure relates to loudspeaker audio systems having reduced vibration.

A moving diaphragm in an electro-acoustic transducer generates a reaction force on a basket supporting the diaphragm that is transmitted to an enclosure or baffle that partitions a volume into a listening volume and a back volume. The baffle is typically lightweight and stiff in the plane of the baffle but susceptible to vibrations perpendicular to the baffle plane. A reaction force having a component perpendicular to the baffle plane can generate a buzzing or an audible noise that detracts from the acoustic signal generated by the electro-acoustic transducer. A heavy enclosure may reduce the buzzing or audible noise generated by the reaction force but at the expense of the weight of the enclosure.

U.S. Pat. No. 6,985,593 issued Jan. 10, 2006, U.S. Publication No. US2005/0111673 published May 26, 2005, and co-pending U.S. application Ser. No. 11/591,285 filed Nov. 1, 2006 describe methods and systems for reducing baffle vibrations and are incorporated herein by reference in their entirety. In the described methods and systems, two or more diaphragms are oriented relative to each other such that the net reaction force generated by the two or more diaphragms is preferably zero or less than the reaction force generated by a single diaphragm.

SUMMARY

A system and method for reducing baffle vibration includes balancing an inertial force generated by two or more moving diaphragms and balancing an acoustic pressure acting on a housing supporting the two or more moving diaphragms such that a net force acting on the baffle is substantially zero. The acoustic force acting on the housing may be balanced independently of the inertial force balance. In another configuration, the acoustic force acting on the housing may be balanced by a non-zero net inertial force.

One embodiment of the present invention is directed to an apparatus comprising: a first electro-acoustic transducer having a first diaphragm, the first diaphragm characterized by a first axis defining a movement of the first diaphragm; a second electro-acoustic transducer having a second diaphragm, the second diaphragm characterized by a second axis defining a movement of the second diaphragm; and a housing supporting the first and second electro-acoustic transducers, the housing maintaining the first axis in a predetermined orientation relative to the second axis, wherein a vector sum of an inertial force generated by the first diaphragm, an inertial force generated by the second diaphragm and an acoustic force is substantially zero. In an aspect, a first component of the inertial force generated by the first diaphragm and a first component of the inertial force generated by the second diaphragm are balanced by the acoustic force. In a further aspect, a second component of the inertial force generated by the first diaphragm is balanced by a second component of the inertial force generated by the second diaphragm. In another aspect, the housing is attached to a baffle, the baffle selected from a group consisting of a vehicle instrument panel, a vehicle rear package shelf, a vehicle door trim panel, a vehicle inner door skin, a room wall, a room floor and a room ceiling. In another aspect, the housing is attached to an enclosure. In another aspect, the housing includes: a front-side duct having a front-side end-wall, a front-side of the first diaphragm and a front-side of the second diaphragm directly coupled to the front-side duct; a first back-side duct having a first back-side end-wall, a back-side of the first diaphragm directly coupled to the first back-side duct; and a second back-side duct having a second back-side end-wall, a back-side of the second diaphragm directly coupled to the second back-side duct, wherein a vector sum of an acoustic force on the front-side end-wall, an acoustic force on the first back-side end-wall, and an acoustic force on the second back-side end-wall is substantially zero. In a further aspect, the first axis is collinear with the second axis.

Another embodiment of the present invention is directed to an apparatus comprising: at least two electro-acoustic transducers, each electro-acoustic transducer having a diaphragm, each diaphragm characterized by an axis defining a movement of the diaphragm; a housing supporting the at least two electro-acoustic transducers, the housing maintaining each of the axes in a predetermined orientation relative to each other, wherein a vector sum of an inertial force generated by a movement of each of the at least two diaphragms and an acoustic force is substantially zero. In an aspect, a projection of each axis onto a plane parallel to a baffle creates an angle with an adjacent axis of 360°/n, where n is the number of electro-acoustic transducers supported by the housing. In another aspect, a component of the acoustic force in a first direction is balanced by a sum of components of the inertial forces in the first direction.

Another embodiment of the present invention is directed to an apparatus comprising: a first electro-acoustic transducer having a first diaphragm, the first diaphragm characterized by a first axis defining a movement of the first diaphragm; a second electro-acoustic transducer having a second diaphragm, the second diaphragm characterized by a second axis defining a movement of the second diaphragm; a housing supporting the first and second electro-acoustic transducers, the housing maintaining the first axis collinear to the second axis; and an acoustic balancer providing a surface acted upon by an acoustic pressure resulting in a force balancing an acoustic force on a portion of the housing, wherein the net acoustic force is reduced. In an aspect, the acoustic balancer is a pedestal having a stem attached to a housing floor and a plate overhanging an opening to a listening volume, the plate providing a surface acted upon by the acoustic pressure.

Another embodiment of the present invention is directed to a method for reducing baffle vibration comprising: balancing a first inertial force generated by a first diaphragm with a second inertial force generated by a second diaphragm; and balancing an acoustic force generated by the first and second diaphragm, wherein a net force transmitted to the baffle, the net force comprising a vector sum of the balanced inertial force and acoustic force is substantially zero. In an aspect, balancing the acoustic force is performed independently of balancing the inertial force. In another aspect, the acoustic force is balanced by a net inertial force comprising a component of the first and second inertial force. In another aspect, balancing the first and second inertial force further includes orienting an axis characterizing a motion of the first diaphragm relative to an axis characterizing a motion of the second diaphragm.

DETAILED DESCRIPTION

Figure 1:
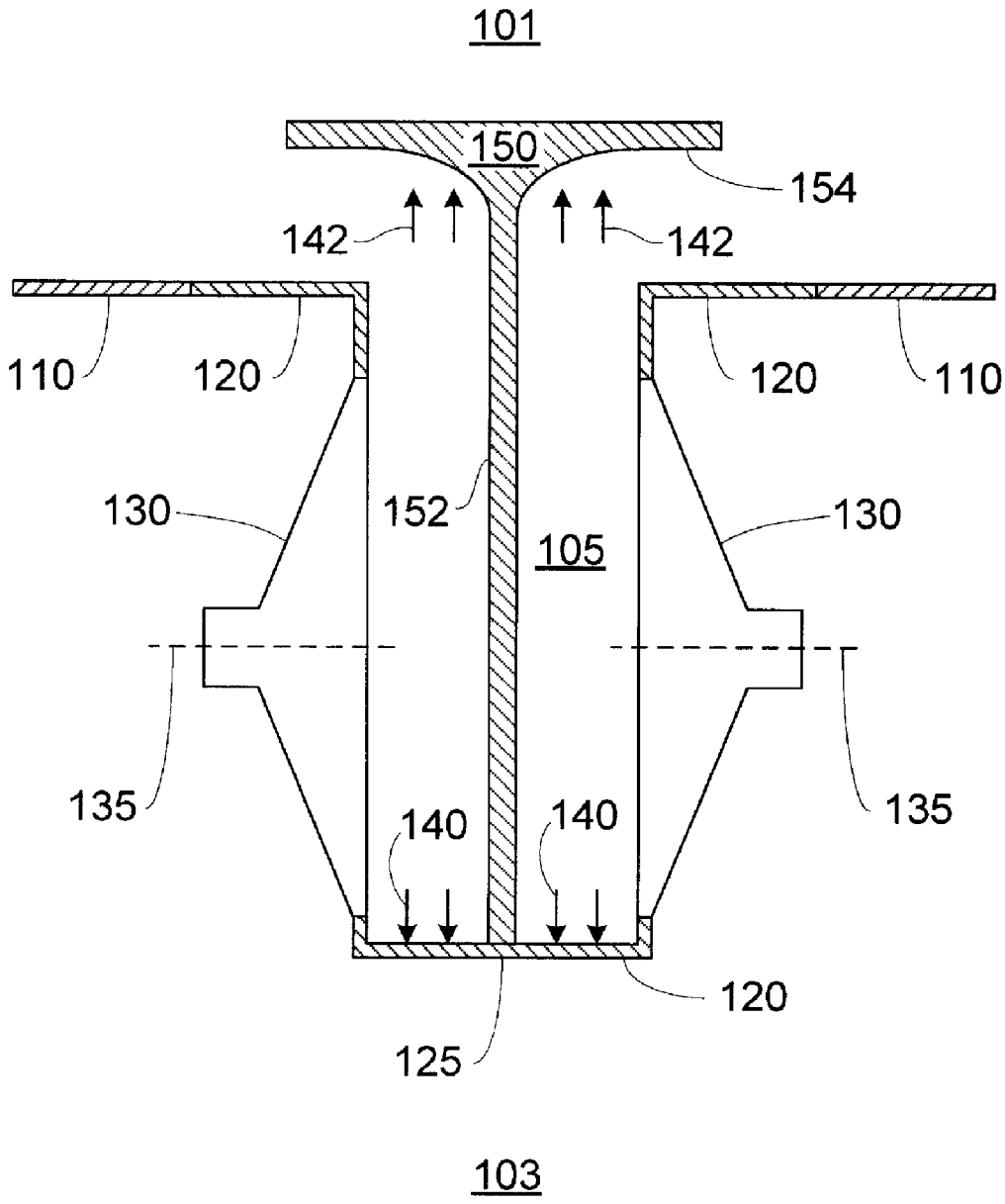
FIG. 1 is a side schematic view of an embodiment of the present invention.

In the example shown in FIG. 1, housing 120 supports two electro-acoustic transducers 130. The housing 120 is attached to a baffle or enclosure 110 and co-acts with the baffle 110 to partition a listening volume 101 from a back volume 103. The baffle 110 may be an interior surface of a vehicle or a room such as, for example, a vehicle instrument panel, a vehicle rear package shelf, a vehicle door trim panel, a vehicle inner door skin, a room floor, a room wall, or a room ceiling.

Each electro-acoustic transducer 130 is characterized by an axis 135 that defines the displacement of the transducer's diaphragm. The diaphragm, also referred to as a speaker cone, is supported by a surround and a spider. An outer edge of the diaphragm is circumferentially attached to an inner edge of the surround. An inner edge of the diaphragm is attached to a bobbin. An inner edge of the spider is attached to the bobbin. An outer edge of the surround and an outer edge of the spider are attached to a basket. The surround and spider preferably restricts the movement of the diaphragm along an axis 135 of the electro-acoustic transducer. The basket supports a magnet, a pole plate, a rear pole plate and pole piece. The bobbin is disposed within an annular gap formed between the pole plate and pole piece. A wire coil is wound around the bobbin, the bobbin and coil comprising a voice-coil, and receives an electrical signal representing an acoustic signal. The wire coil generates a magnetic field in response to the applied electrical signal, which interacts with the field produced by magnet causing the diaphragm to move relative to the basket and along the axis 135. A dust cover attached to the diaphragm prevents particles from accumulating in the gap. The mass of the moving parts, such as the diaphragm, voice coil, etc., collectively referred to hereinafter as the diaphragm, creates an inertial force on the basket as the diaphragm is accelerated by the interacting magnetic fields. Further details regarding the construction and operation of electro-acoustic transducers may be found in, for example, pending U.S. application Ser. No. 11/680,358 filed Feb. 28, 2007, herein incorporated by reference in its entirety.

In the example shown in FIG. 1, each electro-acoustic transducer 130 is supported by housing 120 such that the axes of the electro-acoustic transducers 130 are collinear. As the diaphragm moves along axis 135, a reaction force, also referred to herein as an inertial force, is generated and applied to the basket and is transmitted to the housing 120 and to the baffle 110. Each diaphragm of the electro-acoustic transducers has a front face that is directly coupled to a cavity 105 and a rear face that is directly coupled to the back volume 103. The cavity 105 is bounded by the housing 120 and electro-acoustic transducers 130 and has an opening to the listening volume 101. In a preferred embodiment, the electro-acoustic transducers 130 are of the same type and are electrically driven with equal amplitudes and substantially in-phase such that the diaphragms of both electro-acoustic transducers 130 are displaced into or out of the cavity 105 in unison.

As the diaphragms of the electro-acoustic transducers 135 move in unison, the reaction force on housing 120 generated by one electro-acoustic transducer is balanced by the reaction force generated by the other electro-acoustic transducer such that the net reaction force, i.e., the vector sum of the reaction force on each electro-acoustic transducer basket, transmitted to the baffle is substantially zero. It should be understood that exact balancing of the reaction forces is unlikely in any macroscopic system and the term "substantially zero" should be understood to mean that the net resultant force of the two or more reaction forces is at least one order of magnitude (10%), and preferably at least two orders of magnitude (1%), less than the reaction force generated by a single diaphragm.

The reaction force generated by diaphragm movement, however, is not the only force acting on the baffle. For example, as the diaphragms of the electro-acoustic transducers 130 move into cavity 105, the pressure in the cavity increases and exerts a force on the cavity walls and floor. The pressure generated by the moving diaphragms in the cavity creates the sound heard in the listening volume and is herein referred to as the acoustic pressure. As used herein, an acoustic force is the acoustic pressure acting on a portion of the cavity surface. The acoustic force on a wall of the cavity is balanced by the acoustic force on the opposite wall of the cavity resulting in a substantially zero net force applied to the cavity walls. The acoustic force applied to the cavity floor 125 of housing 120, however, is not balanced because of the opening of the cavity into the listening volume. The unbalanced acoustic force on the cavity floor, indicated in FIG. 1 by arrows 140, is transmitted to the baffle and can generate undesirable baffle vibration or buzz.

An acoustic balancer such as, for example, a pedestal 150 is attached to the floor 125 of the housing 120. The pedestal 150 includes a vertical stem 152 attached to the cavity floor 125 and topped by a plate 154 that overhangs the cavity opening. The acoustic pressure acting on the bottom of the plate 154 generates an acoustic force that can at least partially balance the acoustic force on the cavity floor 125 such that the net resultant acoustic force is reduced. The acoustic force acting on the pedestal 150, indicated by arrows 142, typically is less than the acoustic force acting on the cavity floor 125 such that the vector sum of acoustic forces 140 and 142 is only partially balanced.

In the example shown in FIG. 1, the acoustic forces are balanced independently of the inertial forces such that the vector sum of the inertial forces is substantially zero and is independent of the vector sum of the acoustic forces. The inertial forces generated by the diaphragms of the electro-acoustic transducers shown in FIG. 1 have non-zero components of the force vector only in the lateral direction. As used herein, a force vector may be composed of a sum of three vector components. Each vector component is a product of a scalar quantity representing a magnitude and a unit basis vector. Each unit basis vector is orthogonal to the other two basis vectors and each has unit magnitude. In the example shown in FIG. 1, a first basis vector may represent a left to right, or lateral, direction, a second basis vector may represent a bottom to top, or vertical, direction, and a third basis vector may represent a direction out of the plane of FIG. 1 or depth direction. The inertial force components in the vertical axis, describing the motion up and down in the plane shown in FIG. 1, and the depth axis, describing the motion in and out of the plane of FIG. 1, are both substantially zero and results in a substantially zero force component in the vertical and depth directions. In the lateral direction, the inertial force component in the lateral direction of the left electro-acoustic transducer is substantially equal and opposite to the inertial force component in the lateral direction of the right electro-acoustic transducer such that the sum of the lateral components of the inertial forces is substantially zero. The acoustic forces on a vertical wall of the cavity is balanced by the acoustic force on the opposite wall of the cavity such that the sum of the lateral components of the acoustic force is substantially zero and the sum of the depth components of the acoustic force is substantially zero. In the example shown in FIG. 1, the vertical component of the acoustic force is given by the sum of the force acting on the cavity floor and the acoustic force acting on a portion of plate 154 over the cavity opening. The acoustic pressure near the opening of the cavity is less than the acoustic pressure near the floor of the cavity such that the sum of the acoustic force in the vertical direction is reduced but is non-zero.

Figure 2:
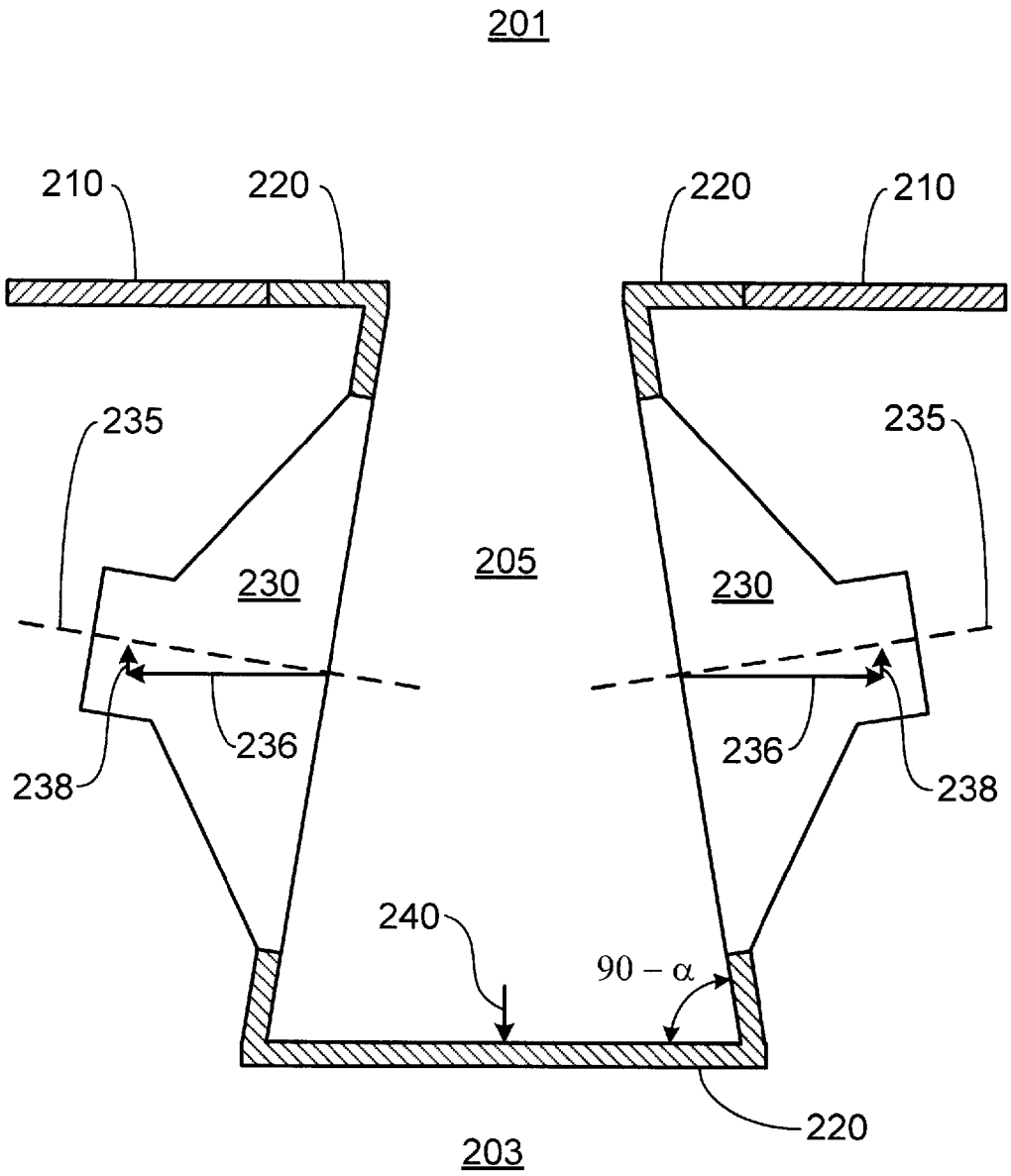
FIG. 2 is a side schematic view of another embodiment of the present invention.

FIG. 2 illustrates another embodiment that eliminates the need for a pedestal shown in FIG. 1. In FIG. 2, housing 220 supports two electro-acoustic transducers 230. The housing 220 is attached to a baffle or enclosure 210. The housing 220 and baffle 210 separate a listening volume 201 from a back volume 203. The baffle 210 may be an interior surface of a vehicle or a room such as, for example, a vehicle instrument panel, a vehicle rear package shelf, a vehicle door trim panel, a vehicle inner door skin, a room floor, a room wall, or a room ceiling.

Each diaphragm of the electro-acoustic transducers has a front face that is directly coupled to a cavity 205 and a rear face that is directly coupled to the back volume 203. The cavity 205 is bounded by the housing 220 and electro-acoustic transducers 230 and has an opening to the listening volume 201.

Each electro-acoustic transducer 230 is characterized by an axis 235 that defines the displacement of the transducer's diaphragm. As the diaphragm moves along axis 235, a reaction force is generated that is transmitted to the housing 220 and to the baffle 210. The housing 220 supports the electro-acoustic transducers 230 such that the axis 235 of each electro-acoustic transducer is oriented at an angle, $\alpha$, from the plane of the baffle 210. As the diaphragm moves inward, for example, along its respective axis, the inertial reaction force generated by the diaphragm can be resolved into a horizontal component 236, generally parallel to the baffle, and a vertical component 238. In a symmetrical configuration as shown in FIG. 2, the horizontal force components balance each other resulting in a substantially zero net force. The vertical components 238 of each reaction force add and can be made to balance the acoustic force, indicated by arrow 240, exerted on the housing floor by the selection of $\alpha$.

The selection of $\alpha$ may be made by considering the properties of the electro-acoustic transducers and the dimensions of the cavity. For example, for a pair of electro-acoustic transducers characterized by a major and minor diameter of about 20 cm and 13 cm, respectively, in a cavity of approximately 9 cm wide at the opening, 16 cm high, and 24 cm deep, an $\alpha$ of about 12°, more generally between about 8-15°, is effective in balancing the acoustic pressure on the housing floor. In general, a range of 1-20° for $\alpha$ is believed to cover the range of electro-acoustic transducer-cavity geometry combinations typically encountered.

In the example shown in FIG. 2, the acoustic force and the inertial force are balanced independently of each other in the depth component of the force vectors such that the sum of the acoustic force acting on the front wall of the cavity and the acoustic force acting on the rear wall of the cavity is substantially zero and the sum of the inertial force acting on the front wall and the inertial force acting on the rear wall is substantially zero. In the lateral direction, the acoustic force is balanced independently of the inertial force such that the sum of the acoustic force acting on the left wall and the acoustic force acting on the right wall is substantially zero and the sum of the lateral component of the inertial force 236 acting on the left wall and the lateral component of the inertial force 236 acting on the right wall is substantially zero. In the vertical direction, however, the vertical component 238 of the inertial forces balances the vertical component of the acoustic force 240 such that the sum of the vertical components of the inertial force and the acoustic force is substantially zero. Unlike the example shown in FIG. 1, the example shown in FIG. 2 balances both the acoustic and inertial forces such that the vector sum of the acoustic force and the inertial forces is substantially zero.

Figure 3A:
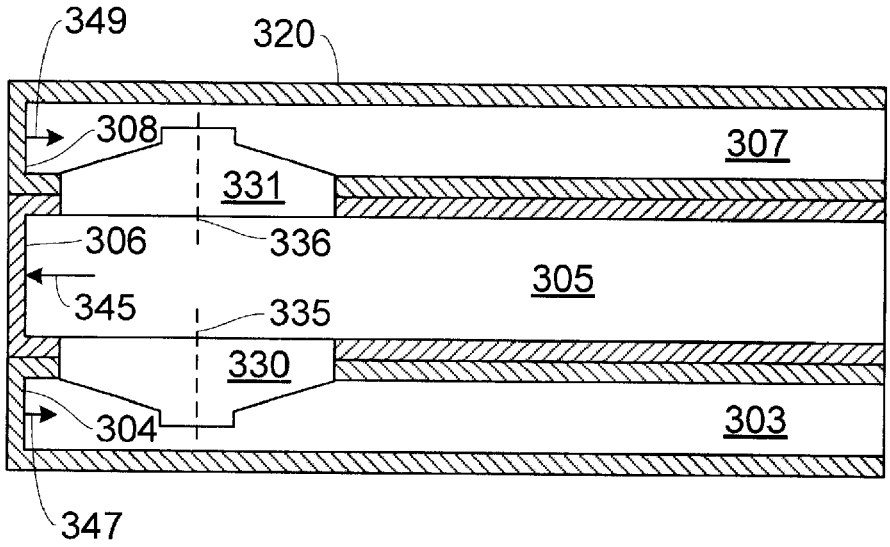
FIG. 3*a* is a top schematic view of another embodiment of the present invention.

FIG. 3*a* is a top schematic view of another configuration, which has front-side and back-side ducts. In FIG. 3*a*, electro-acoustic transducers 330, 331, preferably of the same type, are supported in a housing 320 that includes a front-side duct 305 and back-side ducts 303, 307. The electro-acoustic transducers 330, 331 are oriented such that their axes 335, 336 are collinear. A front side of a diaphragm of each electro-acoustic transducer 330, 331 is directly coupled to the front-side duct 305. A rear side of the diaphragm of electro-acoustic transducer 330 is directly coupled to back-side duct 303 and a rear side of the diaphragm of electro-acoustic transducer 331 is directly coupled to back-side duct 307.

Figure 3B:
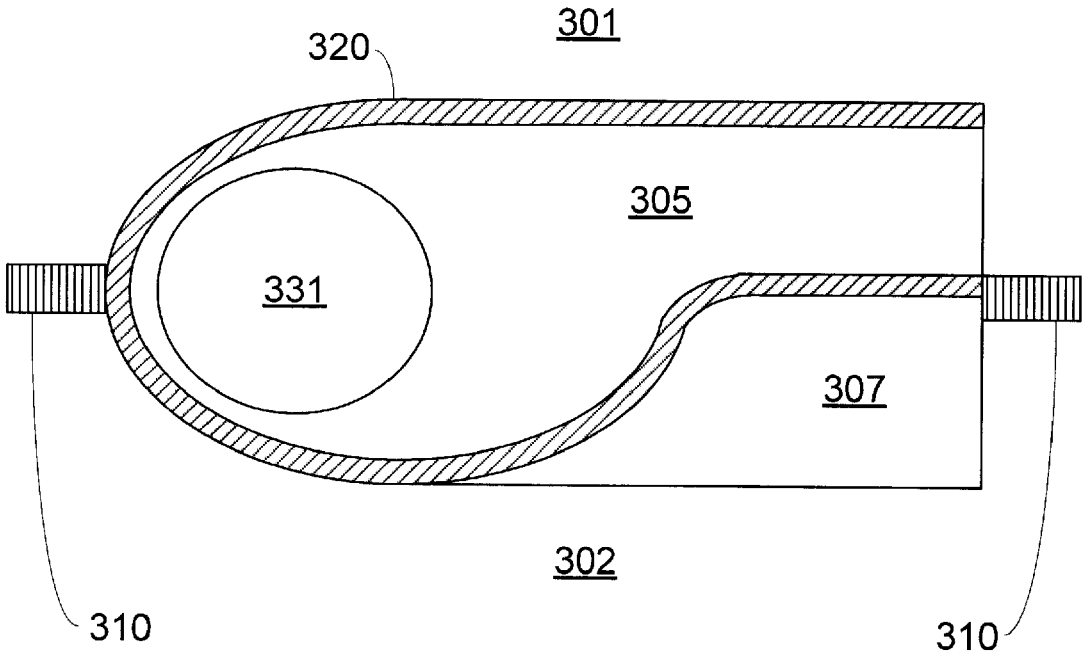
FIG. 3*b* is a side schematic view of the embodiment shown in FIG. 3*a*.

FIG. 3*b* is a side schematic view of the configuration shown in FIG. 3*a*. Housing 320 is attached to baffle or enclosure 310 and together they partition a listening volume 301 from a back volume 302. The baffle 310 may be an interior surface of a vehicle or a room such as, for example, a vehicle instrument panel, a vehicle rear package shelf, a vehicle door trim panel, a vehicle inner door skin, a room wall, a room floor, or a room ceiling. Front-side duct 305 is coupled to listening volume 301. The back-side ducts 303, 307 are coupled to the back volume 302.

The electro-acoustic transducers 330, 331 are preferably driven such that the diaphragm of each electro-acoustic transducer moves into or out of the front-side duct in unison. As both diaphragms are driven into the front-side duct 305, the pressure in the front-side duct increases and exerts an acoustic pressure over an area of end wall 306 generating an acoustic force, indicated by arrow 345 on the end wall 306 of the front-side duct 305. As the diaphragms move into the front-side duct 305, the diaphragms move out of the back-side ducts 303, 307 thereby decreasing the pressure in the back-side ducts 303, 307. The decreased pressure exerts an acoustic pressure over an area of end walls 304 and 308 generating acoustic forces, indicated by arrows 347 and 349, on the end walls 304 and 308, respectively. Together, the acoustic force acting on end walls 304, 308 balance the acoustic force acting on end wall 306. The front-side duct 305 and back-side ducts 303, 307 are sized such that the acoustic forces are balanced and have a substantially zero net torque and a bending strain of the back walls less than 0.1%, preferably less than 0.01%.

In the example shown in FIGS. 3*a* and 3*b*, the acoustic forces are balanced independently of the inertial forces. Both the vector sum of the acoustic forces and the vector sum of the inertial forces are each substantially zero.

Having thus described at least illustrative embodiments of the invention, various modifications and improvements will readily occur to those skilled in the art and are intended to be within the scope of the invention. For example, although two electro-acoustic transducers are shown in the figures, any number of electro-acoustic transducers may be used. For example, a three electro-acoustic transducer configuration may be made such that each transducer axis intersects the other axes at a point that lies on a vertical rotation axis of the cavity and makes a 360°/3=120° angle with its adjacent axes. Similarly, four electro-acoustic transducers may be configured such that each transducer axis intersects the other axes at a point on the vertical rotation axis of the cavity and makes a 360°/4=90° angle with its adjacent axes. Accordingly, the foregoing description is by way of example only and is not intended as limiting. The invention is limited only as defined in the following claims and the equivalents thereto.

What is claimed:

1. An apparatus comprising:

a first electro-acoustic transducer having a first diaphragm, the first diaphragm characterized by a first axis defining a movement of the first diaphragm;

a second electro-acoustic transducer having a second diaphragm, the second diaphragm characterized by a second axis defining a movement of the second diaphragm; and a housing supporting the first and second electro-acoustic transducers, the housing maintaining the first axis in a predetermined, non-colinear, orientation relative to the second axis, wherein a vector sum of an inertial force generated by the first diaphragm, an inertial force generated by the second diaphragm and an acoustic force is substantially zero, a first component of the inertial force generated by the first diaphragm and a first component of the inertial force generated by the second diaphragm are balanced by the acoustic force, and a second component of the inertial force generated by the first diaphragm is balanced by a second component of the inertial force generated by the second diaphragm, the first components of the inertial forces generated by the first and second diaphragms and the balancing acoustic force all being orthogonal to the second components of the inertial forces generated by the first and second diaphragms.

2. The apparatus of claim 1 wherein the housing is attached to a baffle, the baffle selected from a group consisting of a vehicle instrument panel, a vehicle rear package shelf, a vehicle door trim panel, a vehicle inner door skin, a room wall, a room floor and a room ceiling.

3. The apparatus of claim 1 wherein the housing is attached to an enclosure.

4. The apparatus of claim 1 wherein the housing includes:

a front-side duct having a front-side end-wall, a front-side of the first diaphragm and a front-side of the second diaphragm directly coupled to the front-side duct;

a first back-side duct having a first back-side end-wall, a back-side of the first diaphragm directly coupled to the first back-side duct; and a second back-side duct having a second back-side end-wall, a back-side of the second diaphragm directly coupled to the second back-side duct, wherein a vector sum of an acoustic force on the front-side end-wall, an acoustic force on the first back-side end-wall, and an acoustic force on the second back-side end-wall is substantially zero.

5. An apparatus comprising:

at least two electro-acoustic transducers, each electro-acoustic transducer having a diaphragm, each diaphragm characterized by an axis defining a movement of the diaphragm;

a housing supporting the at least two electro-acoustic transducers, the housing maintaining each of the axes in a predetermined, non-colinear, orientation relative to each other, wherein a vector sum of an inertial force generated by a movement of each of the at least two diaphragms and an acoustic force is substantially zero, a vector sum of first components of the inertial forces generated by the at least two diaphragms is balanced by the acoustic force, and a vector sum of second components of the inertial forces generated by the at least two diaphragms is substantially zero, the first components of the inertial forces generated by the at least two diaphragms and the balancing acoustic force all being orthogonal to the second components of the inertial forces generated by the at least two diaphragms.

6. The apparatus of claim 5 wherein a projection of each axis onto a plane parallel to a baffle creates an angle with an adjacent axis of 360°/n, where n is the number of electro-acoustic transducers supported by the housing.

7. An apparatus comprising:

a first electro-acoustic transducer having a first diaphragm, the first diaphragm characterized by a first axis defining a movement of the first diaphragm;

a second electro-acoustic transducer having a second diaphragm, the second diaphragm characterized by a second axis defining a movement of the second diaphragm;

a housing supporting the first and second electro-acoustic transducers, the housing maintaining the first axis collinear to the second axis; and an acoustic balancer providing a surface acted upon by an acoustic pressure resulting in a force balancing an acoustic force on a portion of the housing, wherein the net acoustic force is reduced, and wherein the acoustic balancer is a pedestal having a stem attached to a housing floor and a plate overhanging an opening to a listening volume, the plate providing a surface acted upon by the acoustic pressure.

8. A method for reducing baffle vibration comprising:

orienting an axis characterizing a motion of a first diaphragm to be non-colinear to an axis characterizing a motion of a second diaphragm, balancing a first component of a first inertial force generated by the first diaphragm with a first component of a second inertial force generated by the second diaphragm; and balancing an acoustic force generated by the first and second diaphragm by a net inertial force comprising a sum of second components of the first and second inertial forces, wherein a net force transmitted to the baffle, the net force comprising a vector sum of the balanced inertial force and acoustic force, is substantially zero the second components of the inertial forces generated by the first and second diaphragms and the balanced acoustic force all being orthogonal to the first components of the inertial forces generated by the first and second diaphragms.

9. The method of claim 8 wherein balancing the acoustic force is performed independently of balancing the inertial force.

* * * * *